US010605221B2

(12) United States Patent
Loveall et al.

(10) Patent No.: US 10,605,221 B2
(45) Date of Patent: Mar. 31, 2020

(54) METHODS AND SYSTEM FOR POSITIONING AN ENGINE FOR STARTING

(71) Applicant: Ford Global Technologies, LLC, Dearborn, MI (US)

(72) Inventors: Seth Loveall, Dearborn, MI (US); Stephen Powell, Troy, MI (US); Patrick Collins, Canton, MI (US); Anthony Boyko, Dearborn Heights, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 17 days.

(21) Appl. No.: 16/051,321

(22) Filed: Jul. 31, 2018

(65) Prior Publication Data

US 2020/0040861 A1 Feb. 6, 2020

(51) Int. Cl.

| | |
|---|---|
| ***F02N 19/00*** | (2010.01) |
| ***F02D 41/04*** | (2006.01) |
| ***F02N 11/08*** | (2006.01) |

(52) U.S. Cl.

CPC ..... *F02N 19/005* (2013.01); *F02D 41/042* (2013.01); *F02N 11/0814* (2013.01); *F02N 2019/008* (2013.01)

(58) Field of Classification Search

CPC .. F02N 19/005; F02N 41/942; F02N 11/0814; F02N 2019/008

USPC ..... 123/179.4

See application file for complete search history.

(56) References Cited

U.S. PATENT DOCUMENTS

| | | | | |
|---|---|---|---|---|
| 6,782,860 | B2 | 8/2004 | Makajima et al. | |
| 9,393,954 | B2 | 7/2016 | Gibson et al. | |
| 2005/0113211 | A1* | 5/2005 | Surewaard | F02B 75/06 477/92 |
| 2007/0099749 | A1* | 5/2007 | Zillmer | B60W 20/00 477/3 |
| 2009/0287400 | A1 | 11/2009 | Pursifull | |
| 2012/0259535 | A1* | 10/2012 | Jaros | F02N 11/04 701/113 |
| 2014/0278018 | A1 | 9/2014 | Gibson et al. | |
| 2015/0224985 | A1* | 8/2015 | Gotou | B60W 20/40 701/22 |
| 2017/0282890 | A1* | 10/2017 | Fujimoto | B60W 10/08 |

* cited by examiner

*Primary Examiner* — Mahmoud Gimie

(74) *Attorney, Agent, or Firm* — Geoffrey Brumbaugh; McCoy Russell LLP

(57) ABSTRACT

Systems and methods for operating an engine that may be frequently stopped and restarted are described. In one example, an engine is rotated in small crankshaft angle increments and stopped after the engine is rotated through a predetermined actual total number of crankshaft degrees so that the engine position does not change when the engine reaches a desired position.

20 Claims, 5 Drawing Sheets

METHODS AND SYSTEM FOR POSITIONING AN ENGINE FOR STARTING

FIELD

The present description relates to methods and a system for prepositioning an engine for starting so that engine cranking time is short and engine starting is fast.

BACKGROUND AND SUMMARY

An engine may stop one time in a position where engine cranking time is short and engine starting is fast after a first engine stop, and the same engine may stop a second time in a position where engine cranking is long and engine starting is slower. The engine may start fast if the engine is stopped at a position near intake valve closing time of one cylinder so that the engine reaches a top-dead-center compression position with a cylinder full air charge in a short duration of crankshaft rotation. On the other hand, the engine may take longer to start if the engine is stopped away from an intake valve closing time of an engine cylinder such that the engine crankshaft has to be rotated for a time before an intake valve closing of a cylinder occurs. Further, if combustion begins in a cylinder that has less than a full charge of air and fuel, the engine may not run-up in a desired manner and engine emissions may increase. Consequently, it may be desirable to provide short engine cranking and starting times so that vehicle occupants may not be exposed to inconsistent engine starting times. One way to improve engine starting is to preposition the engine before starting, but the engine may not stay at a desired engine stopping location.

The inventors herein have recognized the above-mentioned issues and have developed an engine operating method, comprising: a plurality of times, rotating and stopping rotation of an engine after an engine stop request and before an engine start request via a controller.

By rotating and stopping an engine a plurality of times after an engine stop request and before an engine start request, it may be possible to provide the technical result of prepositioning an engine for an engine start without the engine changing position after it reaches a desired engine stopping position that reduces engine starting time. Specifically, an engine may be rotated in small crankshaft angle increments and stopped before the engine is rotated again so that pressure in the engine cylinders is close to atmospheric pressure when the engine is finally stopped. This allows the engine to reach its desired final stop position before an engine start without rotating out of its desired final stop position due to pressures in engine cylinders. Consequently, the engine may be started from its desired stop position instead of starting from a position that increases engine cranking time or reduces combustion torque of a first combustion event since the most recent engine stop.

The present description may provide several advantages. In particular, the approach may provide more consistent engine starting times. Further, the approach may prevent the engine from having to be repositioned once it reaches its desired stopping position. Further still, the approach may reduce engine emissions.

The above advantages and other advantages, and features of the present description will be readily apparent from the following Detailed Description when taken alone or in connection with the accompanying drawings.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

BRIEF DESCRIPTION OF THE DRAWINGS

The advantages described herein will be more fully understood by reading an example of an embodiment, referred to herein as the Detailed Description, when taken alone or with reference to the drawings, where.

DETAILED DESCRIPTION

Figure 2:
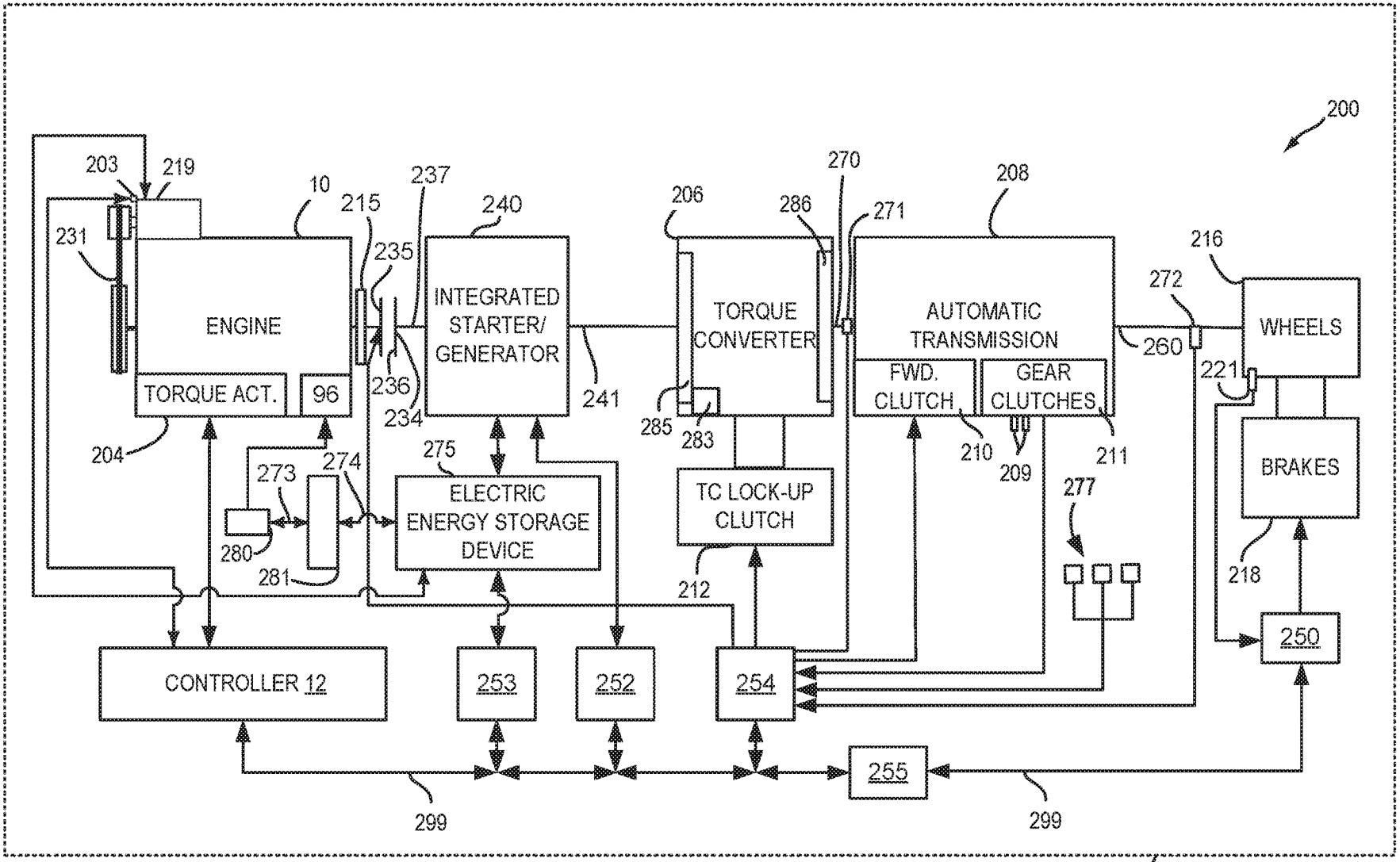
FIG. 2 is a schematic diagram of a hybrid vehicle driveline.
Figure 3:
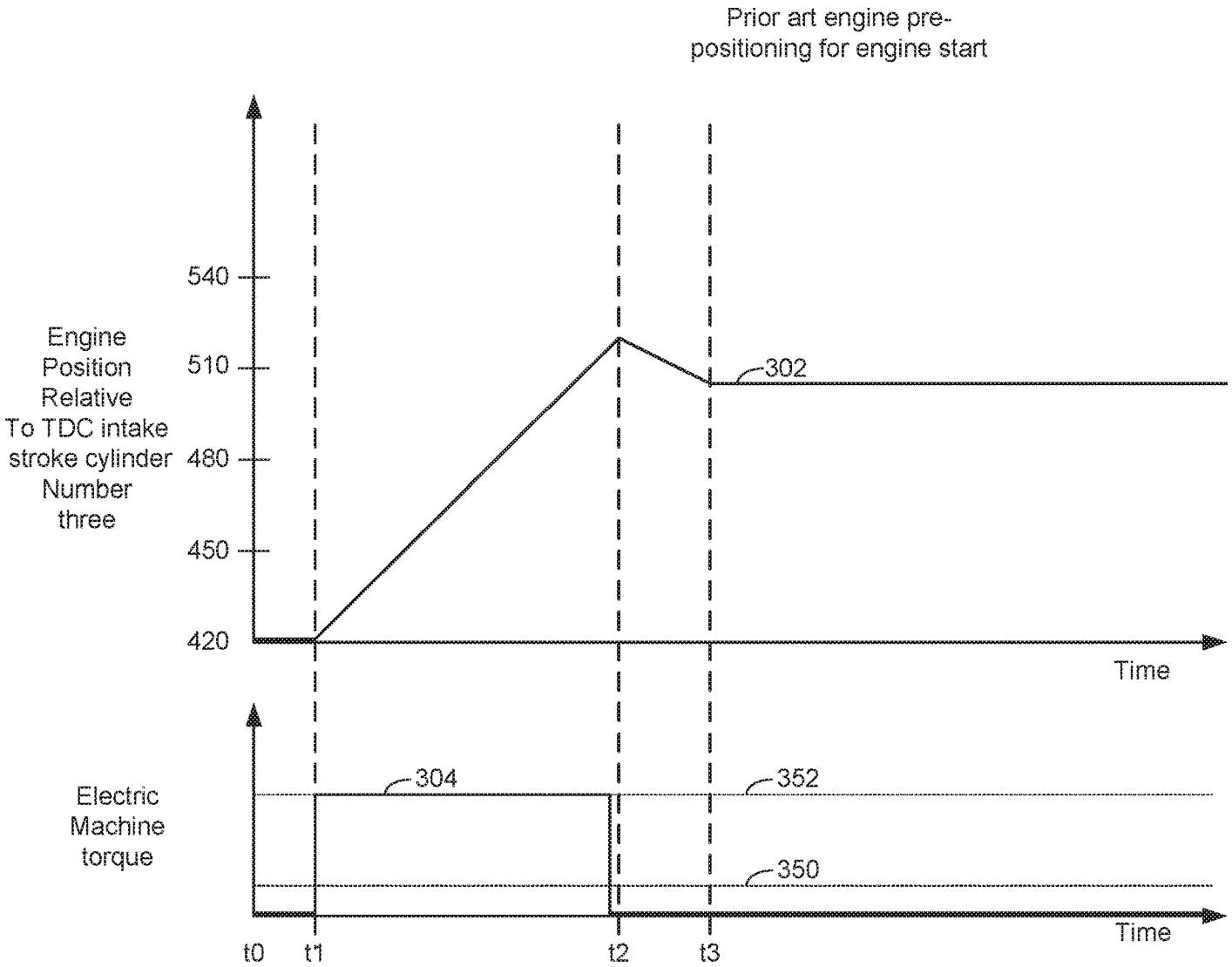
FIG. 3 show an example of a prior art engine stop position control sequence.
Figure 4:
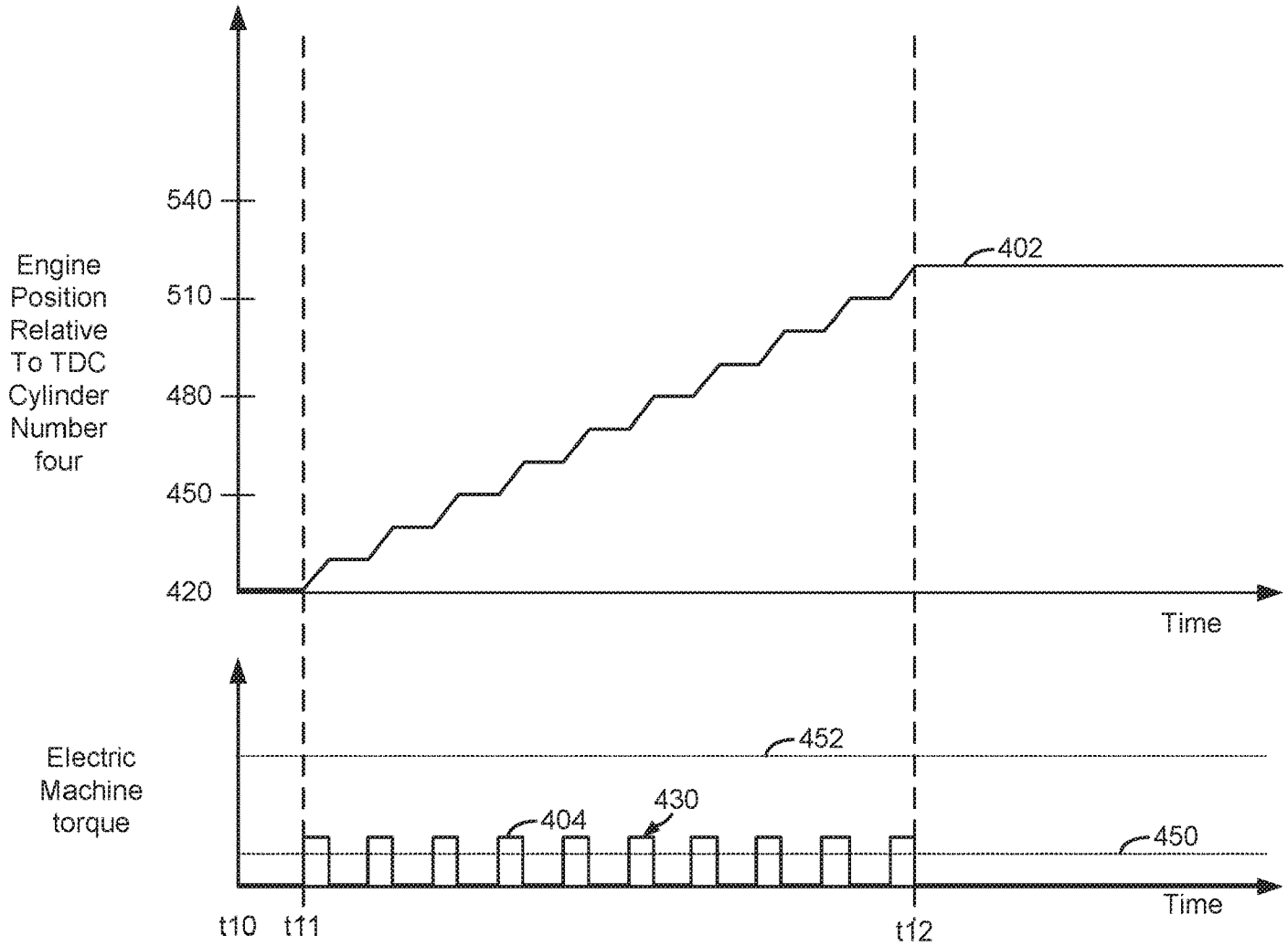
FIG. 4 shows an example engine stop position control sequence according to the present description.

The present description is related to operating an internal combustion engine of a vehicle. The engine may be prepositioned for an engine start after the engine has been commanded off so that engine starting time and engine emissions may be reduced when the engine is restarted. The engine may be of the type shown in FIG. 1. The engine may be part of a powertrain that includes a belt integrated starter/generator (BISG) and an integrated starter/generator (ISG) as is shown in FIG. 2. A starter, the BISG, or the ISG may preposition the engine as shown in FIGS. 3 and 4 (preferably as shown in FIG. 4). The engine may be operated according to the method of FIG. 5 to improve engine starting.

Figure 1:
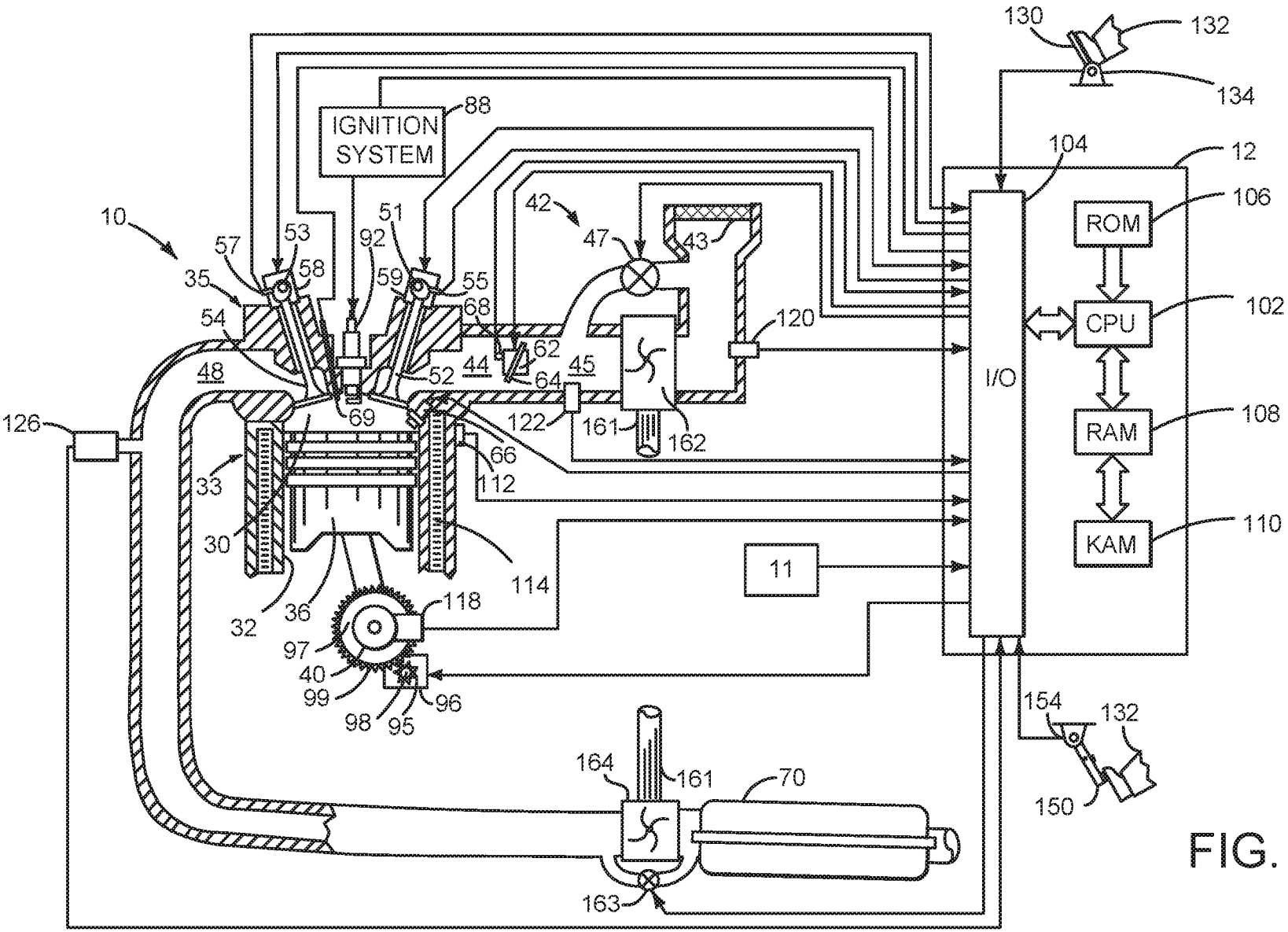
FIG. 1 is a schematic diagram of an engine.

Referring to FIG. 1, internal combustion engine 10, comprising one or more cylinders, one cylinder of which is shown in FIG. 1, is controlled by electronic engine controller 12. The controller 12 receives signals from the various sensors shown in FIGS. 1 and 2. Controller 12 employs the actuators shown in FIGS. 1 and 2 to adjust engine operation based on the received signals and instructions stored in memory of controller 12.

Engine 10 is comprised of cylinder head 35 and block 33, which include combustion chamber 30 and cylinder walls 32. Piston 36 is positioned therein and reciprocates via a connection to crankshaft 40. Flywheel 97 and ring gear 99 are coupled to crankshaft 40. Optional starter 96 (e.g., low voltage (operated with less than 30 volts) electric machine) includes pinion shaft 98 and pinion gear 95. Pinion shaft 98 may selectively advance pinion gear 95 to engage ring gear 99. Starter 96 may be directly mounted to the front of the engine or the rear of the engine. In some examples, starter 96 may selectively supply torque to crankshaft 40 via a belt or chain. In one example, starter 96 is in a base state when not engaged to the engine crankshaft. Further, a current limiting diode may be positioned between starter 96 and an electric energy storage device (e.g., a battery) to limit torque of the starter during engine prepositioning, if desired.

Combustion chamber 30 is shown communicating with intake manifold 44 and exhaust manifold 48 via respective intake valve 52 and exhaust valve 54. Each intake and exhaust valve may be operated by an intake cam 51 and an exhaust cam 53. The position of intake cam 51 may be determined by intake cam sensor 55. The position of exhaust cam 53 may be determined by exhaust cam sensor 57. Intake valve 52 may be selectively activated and deactivated by valve activation device 59. Exhaust valve 54 may be selectively activated and deactivated by valve activation device 58. Valve activation devices 58 and 59 may be electromechanical devices. Pressure in combustion chamber 30 may be sensed via cylinder pressure sensor 69.

Fuel injector 66 is shown positioned to inject fuel directly into cylinder 30, which is known to those skilled in the art as direct injection. Fuel injector 66 delivers liquid fuel in proportion to the pulse width from controller 12. Fuel is delivered to fuel injector 66 by a fuel system (not shown) including a fuel tank, fuel pump, and fuel rail (not shown). In one example, a high pressure, dual stage, fuel system may be used to generate higher fuel pressures.

In addition, intake manifold 44 is shown communicating with turbocharger compressor 162 and engine air intake 42. In other examples, compressor 162 may be a supercharger compressor. Shaft 161 mechanically couples turbocharger turbine 164 to turbocharger compressor 162. Optional electronic throttle 62 adjusts a position of throttle plate 64 to control air flow from compressor 162 to intake manifold 44. Pressure in boost chamber 45 may be referred to a throttle inlet pressure since the inlet of throttle 62 is within boost chamber 45. The throttle outlet is in intake manifold 44. In some examples, throttle 62 and throttle plate 64 may be positioned between intake valve 52 and intake manifold 44 such that throttle 62 is a port throttle. Compressor recirculation valve 47 may be selectively adjusted to a plurality of positions between fully open and fully closed. Wastegate 163 may be adjusted via controller 12 to allow exhaust gases to selectively bypass turbine 164 to control the speed of compressor 162. Air filter 43 cleans air entering engine air intake 42.

Distributorless ignition system 88 provides an ignition spark to combustion chamber 30 via spark plug 92 in response to controller 12. Universal Exhaust Gas Oxygen (UEGO) sensor 126 is shown coupled to exhaust manifold 48 upstream of catalytic converter 70. Alternatively, a two-state exhaust gas oxygen sensor may be substituted for UEGO sensor 126.

Converter 70 can include multiple catalyst bricks, in one example. In another example, multiple emission control devices, each with multiple bricks, can be used. Converter 70 can be a three-way type catalyst in one example.

Controller 12 is shown in FIG. 1 as a conventional microcomputer including: microprocessor unit 102, input/output ports 104, read-only memory 106 (e.g., non-transitory memory), random access memory 108, keep alive memory 110, and a conventional data bus. Controller 12 is shown receiving various signals from sensors coupled to engine 10, in addition to those signals previously discussed, including: engine coolant temperature (ECT) from temperature sensor 112 coupled to cooling sleeve 114; a position sensor 134 coupled to an accelerator pedal 130 for sensing force applied by human driver 132; a position sensor 154 coupled to brake pedal 150 for sensing force applied by human driver 132, a measurement of engine manifold pressure (MAP) from pressure sensor 122 coupled to intake manifold 44; an engine position sensor from a Hall effect sensor 118 sensing crankshaft 40 position; a measurement of air mass entering the engine from sensor 120; and a measurement of throttle position from sensor 68. Barometric pressure may also be sensed (sensor not shown) for processing by controller 12. In a preferred aspect of the present description, engine position sensor 118 produces a predetermined number of equally spaced pulses every revolution of the crankshaft from which engine speed (RPM) can be determined.

Controller 12 may also receive input from human/machine interface 11. A request to start or stop the engine or vehicle may be generated via a human and input to the human/machine interface 11. The human/machine interface may be a touch screen display, pushbutton, key switch or other known device.

During operation, each cylinder within engine 10 typically undergoes a four stroke cycle: the cycle includes the intake stroke, compression stroke, expansion stroke, and exhaust stroke. During the intake stroke, generally, the exhaust valve 54 closes and intake valve 52 opens. Air is introduced into combustion chamber 30 via intake manifold 44, and piston 36 moves to the bottom of the cylinder so as to increase the volume within combustion chamber 30. The position at which piston 36 is near the bottom of the cylinder and at the end of its stroke (e.g. when combustion chamber 30 is at its largest volume) is typically referred to by those of skill in the art as bottom dead center (BDC).

During the compression stroke, intake valve 52 and exhaust valve 54 are closed. Piston 36 moves toward the cylinder head so as to compress the air within combustion chamber 30. The point at which piston 36 is at the end of its stroke and closest to the cylinder head (e.g. when combustion chamber 30 is at its smallest volume) is typically referred to by those of skill in the art as top dead center (TDC). In a process hereinafter referred to as injection, fuel is introduced into the combustion chamber. In a process hereinafter referred to as ignition, the injected fuel is ignited by known ignition means such as spark plug 92, resulting in combustion.

During the expansion stroke, the expanding gases push piston 36 back to BDC. Crankshaft 40 converts piston movement into a rotational torque of the rotary shaft. Finally, during the exhaust stroke, the exhaust valve 54 opens to release the combusted air-fuel mixture to exhaust manifold 48 and the piston returns to TDC. Note that the above is shown merely as an example, and that intake and exhaust valve opening and/or closing timings may vary, such as to provide positive or negative valve overlap, late intake valve closing, or various other examples.

FIG. 2 is a block diagram of a vehicle 225 including a powertrain or driveline 200. The powertrain of FIG. 2 includes engine 10 shown in FIG. 1. Powertrain 200 is shown including vehicle system controller 255, engine controller 12, electric machine controller 252, transmission controller 254, energy storage device controller 253, and brake controller 250. The controllers may communicate over controller area network (CAN) 299. Each of the controllers may provide information to other controllers such as torque output limits (e.g., torque output of the device or component being controlled not to be exceeded), torque input limits (e.g., torque input of the device or component being controlled not to be exceeded), torque output of the device being controlled, sensor and actuator data, diagnostic information (e.g., information regarding a degraded transmission, information regarding a degraded engine, information regarding a degraded electric machine, information regarding degraded brakes). Further, the vehicle system controller 255 may provide commands to engine controller 12, electric machine controller 252, transmission controller 254, and brake controller 250 to achieve driver input requests and other requests that are based on vehicle operating conditions.

For example, in response to a driver releasing an accelerator pedal and vehicle speed, vehicle system controller 255 may request a desired wheel torque or a wheel power level to provide a desired rate of vehicle deceleration. The desired wheel torque may be provided by vehicle system controller 255 requesting a first braking torque from electric machine controller 252 and a second braking torque from brake controller 250, the first and second torques providing the desired braking torque at vehicle wheels 216.

In other examples, the partitioning of powertrain controlling devices may be different than that shown in FIG. 2. For example, a single controller may take the place of vehicle system controller 255, engine controller 12, electric machine controller 252, transmission controller 254, and brake controller 250. Alternatively, the vehicle system controller 255 and the engine controller 12 may be a single unit while the electric machine controller 252, the transmission controller 254, and the brake controller 250 are standalone controllers.

In this example, powertrain 200 may be powered by engine 10 and electric machine 240. In other examples, engine 10 may be omitted. Engine 10 may be started with an engine starting system shown in FIG. 1, via BISG 219, or via driveline integrated starter/generator (ISG) 240 also known as an integrated starter/generator. A speed of BISG 219 may be determined via optional BISG speed sensor 203. In some examples, BISG 219 may be simply referred to as an ISG. Driveline ISG 240 (e.g., high voltage (operated with greater than 30 volts) electrical machine) may also be referred to as an electric machine, motor, and/or generator. Further, torque of engine 10 may be adjusted via torque actuator 204, such as a fuel injector, throttle, etc.

BISG 219 may be mechanically coupled to engine 10 via belt 231 or other means. BISG 219 may be coupled to crankshaft 40 or a camshaft (e.g., 51 or 53 of FIG. 1). BISG 219 may operate as a motor when supplied with electrical power via electric energy storage device 275 or low voltage battery 280. BISG 219 may operate as a generator supplying electrical power to electric energy storage device 275 or low voltage battery 280. Bi-directional DC/DC converter 281 may transfer electrical energy from a high voltage buss 274 to a low voltage buss 273 or vice-versa. Low voltage battery 280 is electrically coupled to low voltage buss 273. Electric energy storage device 275 is electrically coupled to high voltage buss 274. Low voltage battery 280 selectively supplies electrical energy to starter motor 96.

An engine output torque may be transmitted to an input or first side of powertrain disconnect clutch 235 through dual mass flywheel 215. Disconnect clutch 236 may be electrically or hydraulically actuated. The downstream or second side 234 of disconnect clutch 236 is shown mechanically coupled to ISG input shaft 237.

ISG 240 may be operated to provide torque to powertrain 200 or to convert powertrain torque into electrical energy to be stored in electric energy storage device 275 in a regeneration mode. ISG 240 is in electrical communication with energy storage device 275. ISG 240 has a higher output torque capacity than starter 96 shown in FIG. 1 or BISG 219. Further, ISG 240 directly drives powertrain 200 or is directly driven by powertrain 200. There are no belts, gears, or chains to couple ISG 240 to powertrain 200. Rather, ISG 240 rotates at the same rate as powertrain 200. Electrical energy storage device 275 (e.g., high voltage battery or power source) may be a battery, capacitor, or inductor. The downstream side of ISG 240 is mechanically coupled to the impeller 285 of torque converter 206 via shaft 241. The upstream side of the ISG 240 is mechanically coupled to the disconnect clutch 236. ISG 240 may provide a positive torque or a negative torque to powertrain 200 via operating as a motor or generator as instructed by electric machine controller 252.

Torque converter 206 includes a turbine 286 to output torque to input shaft 270. Input shaft 270 mechanically couples torque converter 206 to automatic transmission 208. Torque converter 206 also includes a torque converter bypass lock-up clutch 212 (TCC). Torque is directly transferred from impeller 285 to turbine 286 when TCC is locked. TCC is electrically operated by controller 12. Alternatively, TCC may be hydraulically locked. In one example, the torque converter may be referred to as a component of the transmission.

When torque converter lock-up clutch 212 is fully disengaged, torque converter 206 transmits engine torque to automatic transmission 208 via fluid transfer between the torque converter turbine 286 and torque converter impeller 285, thereby enabling torque multiplication. In contrast, when torque converter lock-up clutch 212 is fully engaged, the engine output torque is directly transferred via the torque converter clutch to an input shaft 270 of transmission 208. Alternatively, the torque converter lock-up clutch 212 may be partially engaged, thereby enabling the amount of torque directly relayed to the transmission to be adjusted. The transmission controller 254 may be configured to adjust the amount of torque transmitted by torque converter 212 by adjusting the torque converter lock-up clutch in response to various engine operating conditions, or based on a driver-based engine operation request.

Torque converter 206 also includes pump 283 that pressurizes fluid to operate disconnect clutch 236, forward clutch 210, and gear clutches 211. Pump 283 is driven via impeller 285, which rotates at a same speed as ISG 240.

Automatic transmission 208 includes gear clutches (e.g., gears 1-10) 211 and forward clutch 210. Automatic transmission 208 is a fixed ratio transmission. The gear clutches 211 and the forward clutch 210 may be selectively engaged to change a ratio of an actual total number of turns of input shaft 270 to an actual total number of turns of wheels 216. Gear clutches 211 may be engaged or disengaged via adjusting fluid supplied to the clutches via shift control solenoid valves 209. Torque output from the automatic transmission 208 may also be relayed to wheels 216 to propel the vehicle via output shaft 260. Specifically, automatic transmission 208 may transfer an input driving torque at the input shaft 270 responsive to a vehicle traveling condition before transmitting an output driving torque to the wheels 216. Transmission controller 254 selectively activates or engages TCC 212, gear clutches 211, and forward clutch 210. Transmission controller also selectively deactivates or disengages TCC 212, gear clutches 211, and forward clutch 210.

Further, a frictional force may be applied to wheels 216 by engaging friction wheel brakes 218. In one example, friction wheel brakes 218 may be engaged in response to the driver pressing his foot on a brake pedal (not shown) and/or in response to instructions within brake controller 250. Further, brake controller 250 may apply brakes 218 in response to information and/or requests made by vehicle system controller 255. In the same way, a frictional force may be reduced to wheels 216 by disengaging wheel brakes 218 in response to the driver releasing his foot from a brake pedal, brake controller instructions, and/or vehicle system controller instructions and/or information. For example, vehicle brakes may apply a frictional force to wheels 216 via controller 250 as part of an automated engine stopping procedure.

In response to a request to accelerate vehicle 225, vehicle system controller may obtain a driver demand torque or power request from an accelerator pedal or other device. Vehicle system controller 255 then allocates a fraction of the requested driver demand torque to the engine and the remaining fraction to the ISG or BISG. Vehicle system controller 255 requests the engine torque from engine controller 12 and the ISG torque from electric machine controller 252. If the ISG torque plus the engine torque is less than a transmission input torque limit (e.g., a threshold value not to be exceeded), the torque is delivered to torque converter 206 which then relays at least a fraction of the requested torque to transmission input shaft 270. Transmission controller 254 selectively locks torque converter clutch 212 and engages gears via gear clutches 211 in response to shift schedules and TCC lockup schedules that may be based on input shaft torque and vehicle speed. In some conditions when it may be desired to charge electric energy storage device 275, a charging torque (e.g., a negative ISG torque) may be requested while a non-zero driver demand torque is present. Vehicle system controller 255 may request increased engine torque to overcome the charging torque to meet the driver demand torque.

In response to a request to decelerate vehicle 225 and provide regenerative braking, vehicle system controller may provide a negative desired wheel torque based on vehicle speed and brake pedal position. Vehicle system controller 255 then allocates a fraction of the negative desired wheel torque to the ISG 240 (e.g., desired powertrain wheel torque) and the remaining fraction to friction brakes 218 (e.g., desired friction brake wheel torque). Further, vehicle system controller may notify transmission controller 254 that the vehicle is in regenerative braking mode so that transmission controller 254 shifts gears 211 based on a unique shifting schedule to increase regeneration efficiency. ISG 240 supplies a negative torque to transmission input shaft 270, but negative torque provided by ISG 240 may be limited by transmission controller 254 which outputs a transmission input shaft negative torque limit (e.g., not to be exceeded threshold value). Further, negative torque of ISG 240 may be limited (e.g., constrained to less than a threshold negative threshold torque) based on operating conditions of electric energy storage device 275, by vehicle system controller 255, or electric machine controller 252. Any portion of desired negative wheel torque that may not be provided by ISG 240 because of transmission or ISG limits may be allocated to friction brakes 218 so that the desired wheel torque is provided by a combination of negative wheel torque from friction brakes 218 and ISG 240.

Accordingly, torque control of the various powertrain components may be supervised by vehicle system controller 255 with local torque control for the engine 10, transmission 208, electric machine 240, and brakes 218 provided via engine controller 12, electric machine controller 252, transmission controller 254, and brake controller 250.

As one example, an engine torque output may be controlled by adjusting a combination of spark timing, fuel pulse width, fuel pulse timing, and/or air charge, by controlling throttle opening and/or valve timing, valve lift and boost for turbo- or super-charged engines. In the case of a diesel engine, controller 12 may control the engine torque output by controlling a combination of fuel pulse width, fuel pulse timing, and air charge. In all cases, engine control may be performed on a cylinder-by-cylinder basis to control the engine torque output.

Electric machine controller 252 may control torque output and electrical energy production from ISG 240 by adjusting current flowing to and from field and/or armature windings of ISG as is known in the art.

Transmission controller 254 receives transmission input shaft position via position sensor 271. Transmission controller 254 may convert transmission input shaft position into input shaft speed via differentiating a signal from position sensor 271 or counting a number of known angular distance pulses over a predetermined time interval. Transmission controller 254 may receive transmission output shaft torque from torque sensor 272. Alternatively, sensor 272 may be a position sensor or torque and position sensors. If sensor 272 is a position sensor, controller 254 may count shaft position pulses over a predetermined time interval to determine transmission output shaft velocity. Transmission controller 254 may also differentiate transmission output shaft velocity to determine transmission output shaft acceleration. Transmission controller 254, engine controller 12, and vehicle system controller 255, may also receive addition transmission information from sensors 277, which may include but are not limited to pump output line pressure sensors, transmission hydraulic pressure sensors (e.g., gear clutch fluid pressure sensors), ISG temperature sensors, and BISG temperatures, and ambient temperature sensors.

Brake controller 250 receives wheel speed information via wheel speed sensor 221 and braking requests from vehicle system controller 255. Brake controller 250 may also receive brake pedal position information from brake pedal sensor 154 shown in FIG. 1 directly or over CAN 299. Brake controller 250 may provide braking responsive to a wheel torque command from vehicle system controller 255. Brake controller 250 may also provide anti-lock and vehicle stability braking to improve vehicle braking and stability. As such, brake controller 250 may provide a wheel torque limit (e.g., a threshold negative wheel torque not to be exceeded) to the vehicle system controller 255 so that negative ISG torque does not cause the wheel torque limit to be exceeded. For example, if controller 250 issues a negative wheel torque limit of 50 N-m, ISG torque is adjusted to provide less than 50 N-m (e.g., 49 N-m) of negative torque at the wheels, including accounting for transmission gearing.

Thus, the system of FIGS. 1 and 2 provides for a system, comprising: an engine; an electric machine; and a controller including executable instructions stored in non-transitory memory to rotate the engine and cease engine rotation a plurality of times after an engine stop request and before an engine start request via the electric machine. The system further comprises additional instructions to stop the engine at a predetermined position after rotating the engine the plurality of times. The system includes where ceasing engine rotation includes stopping the engine when an absolute value of a pressure in an engine cylinder is a threshold pressure greater than atmospheric pressure. The system includes where the electric machine is a belt integrated starter/generator. The system further comprises additional instructions to stop the engine for a predetermined amount of time each of the plurality of times the engine ceases rotating. The system includes where the electric machine is a starter motor.

Referring now to FIG. 3, two plots illustrating a prior art engine prepositioning method are shown. The two plots are time aligned and they occur at a same time. The vertical lines at times t1, t2, and t3 represents times of interest in the sequence.

The first plot from the top of FIG. 3 is a plot of engine position relative to top-dead-intake stroke of cylinder number three of a four cylinder engine with a firing order of 1-3-4-2 versus time. The vertical axis represents engine position relative to top-dead-center compression stroke of cylinder number three of the four cylinder engine. The horizontal axis of the first plot represents time and time increases from the left side of the figure to the right side of the figure.

The second plot from the top of FIG. 3 is a plot of electric machine torque versus time. The vertical axis represents electric machine torque and electric machine torque increases in the direction of the vertical axis arrow. Horizontal line 352 represents electric machine torque when the electric machine is rotating at engine cranking speed for starting an engine (e.g., rotating the engine at 200 RPM via the electric machine without combustion in the internal combustion engine). Horizontal line 350 represents engine friction torque (e.g., a torque to overcome before engine rotation begins when the engine is not rotating). The horizontal axis of the second plot represents time and time increases from the left side of the figure to the right side of the figure.

At time t0, the engine is stopped (not rotating) and the position of the piston in cylinder number three is 420 crankshaft degrees after top-dead-center compression stroke of cylinder number three. Thus, cylinder number three is partially through its intake stroke and before intake valve closing. Since the engine is a four cylinder engine with a firing order of 1-3-4-2, cylinder number four is nearly half way through its exhaust stroke so it will be the second cylinder to fire when the engine is started. Cylinder number one is partially through its compression stroke, so cylinder number one may contain less than half a cylinder's full air charge capacity because air pressure in cylinder number one may be reduced toward atmospheric pressure when the engine is not moved following an engine stop. Therefore, it may be desirable to fire cylinder number three first during an engine restart so that engine acceleration may be increased. Consequently, the engine is stopped at a location that is not optimal for engine starting.

At time t1, the electric machine torque is increased to an amount of an engine cranking torque and the engine begins to rotate. The engine may be positioned to its desired engine stop position for restarting the engine (e.g., within a predetermined number of crankshaft degrees of intake valve closing of a cylinder) in a short period of time by rotating the engine at cranking speed. The engine accelerates after time t1 and it rotates toward the desired engine stopping position (e.g., a crankshaft position that is within a predetermined crankshaft angular interval of intake valve closing of a cylinder). The engine rotates through 100 crankshaft degrees between time t1 and time t2. The electric machine torque is reduced to zero just before time t2.

At time t2, the engine decelerates to its desired stopping position. However, the engine rotates backward after reaching its desired stopping position due to pressures in the engine cylinders that developed as the electric machine increased pressure in some engine cylinders and increased vacuum in other engine cylinders. The pressure or vacuum in engine cylinders provides a motive force to the pistons that cause the engine to rotate in a reverse direction after reaching its desired engine stopping position. Consequently, the engine stopping position is not the desired engine stopping position, which may increase the engine cranking time during the next engine restart. The engine rotates in a reverse direction from time t2 to time t3. At time t3, the engine fully stops and the engine is not moved again until a subsequent engine restart (not shown).

Thus, while the prior art method may improve the engine stopping position for a subsequent engine restart, the engine may not actually assume its desired engine stopping position due to pressures or vacuums in engine cylinders that cause the engine to rotate. Consequently, the engine cranking time may be greater than is desired.

Referring now to FIG. 4, two prophetic plots illustrating engine prepositioning according to the present method are shown. The two plots are time aligned and they occur at a same time. The vertical lines at times t10, t11, and t12 represents times of interest in the sequence. The engine operating sequence may be performed via the system of FIGS. 1 and 2 in cooperation with the method of FIG. 5. Vertical lines at times t10-t12 represent times of interest during the sequence.

The first plot from the top of FIG. 4 is a plot of engine position relative to top-dead-intake stroke of cylinder number three of a four cylinder engine with a firing order of 1-3-4-2 versus time. The vertical axis represents engine position relative to top-dead-center compression stroke of cylinder number three of the four cylinder engine. The horizontal axis of the first plot represents time and time increases from the left side of the figure to the right side of the figure.

The second plot from the top of FIG. 4 is a plot of electric machine torque versus time. The vertical axis represents electric machine torque and electric machine torque increases in the direction of the vertical axis arrow. Horizontal line 452 represents average electric machine torque when the electric machine is rotating at engine cranking speed for starting an engine (e.g., rotating the engine at 200 RPM via the electric machine without combustion in the internal combustion engine). Horizontal line 450 represents engine friction torque (e.g., a torque to overcome before engine rotation begins when the engine is not rotating). The horizontal axis of the second plot represents time and time increases from the left side of the figure to the right side of the figure.

At time t10, the engine is stopped and the position of the piston in cylinder number three is 420 crankshaft degrees after top-dead-center compression stroke of cylinder number three. Thus, the engine is shown stopping at the same position the engine stops in FIG. 3. Cylinder number three is partially through its intake and before intake valve closing. Since the engine is a four cylinder engine with a firing order of 1-3-4-2, cylinder number four is nearly half way through its exhaust stroke so it will be the second cylinder to fire when the engine is started. Cylinder number one is partially through its compression stroke, so cylinder number one may contain less than half a cylinder's full air charge capacity because air pressure in cylinder number one may be reduced toward atmospheric pressure when the engine is not moved following an engine stop. As a result, it may be desirable to fire cylinder number three first during an engine restart so that engine acceleration may be increased. Consequently, the engine is stopped at a location that is not optimal for engine starting.

At time t11, the electric machine torque is increased to an amount that is greater than engine friction torque (e.g., level 450) but less than engine cranking torque (e.g., level 452). By increasing electric machine torque to a level that is greater than level 450 but less than level 452, the engine may be slowly rotated so that a pressure change in the cylinder due to engine rotation may be constrained to a small amount that does not cause the engine to rotate when the electric machine ceases to supply torque to the engine. The engine may be rotated to its desired engine stop position for restarting the engine (e.g., within a predetermined number of crankshaft degrees of intake valve closing of a cylinder) by rotating the engine a small amount and then stopping the engine rotation a plurality of times as shown between time t11 and time t12.

The amount of torque delivered to rotate the engine via the electric machine is greater than the engine friction amount but less than the amount to crank the engine during engine starting. By applying a torque amount that is less than the engine starting cranking torque and greater than the engine friction torque, it may be possible to limit the amount of force that is applied to the engine's pistons via pressures in the engine's cylinders so that the engine does not rotate when it is stopped. In addition, by stopping engine rotation between engine rotating events, pressure in engine cylinders is allowed to evolve toward atmospheric pressure so that pressure in engine cylinders may be low with respect to atmospheric pressure even though some pistons in engine cylinders are approaching top dead center compression stroke as the engine is rotated. Consequently, small engine rotational movements followed by engine stop periods where air may be permitted to pass by piston rings may allow the engine to reach its desired stop position without rotating in forward or reverse directions. Additionally, a holding torque may not need to be applied by the electric machine to maintain engine position so that electrical power consumption may be reduced.

The engine accelerates after time t11 and it rotates toward the desired engine stopping position (e.g., a crankshaft position that is within a predetermined crankshaft angular interval of intake valve closing of a cylinder). The engine rotates through 100 crankshaft degrees between time t11 and time t12. The electric machine torque is reduced to zero at or just before time t12.

At time t12, engine rotation is stopped for a final time before the engine is subsequently rotated in response to a request to start the engine (not shown). The engine is stopped at the desired engine stopping position, 520 crankshaft degrees after top-dead-center compression stroke of cylinder number three in this example. The engine is stopped a predetermined actual total number of crankshaft degrees before intake valve closing of cylinder number three so that the engine may be started by introducing a first combustion event since the most recent engine stop in cylinder number three. Because the engine is stopped at a position just before intake valve closing of cylinder number three, cylinder number three begins combustion in the engine with a full cylinder air charge amount.

Thus, the engine may be rotated to a desired engine stopping position for a subsequent engine restart without supplying a holding torque to the engine by the electric machine (e.g., a torque supplied by the electric machine to prevent engine rotation). Further, the engine may stay at the desired engine stopping position without rotating in forward or reverse direction when the electric machine ceases to supply torque to the engine. Note that the description of FIG. 4 mentions engine prepositioning relative to cylinder number three; however, the method described herein may position the engine relative to any particular engine cylinder. The method is not constrained to positioning the engine relative to only cylinder number three.

Figure 5:
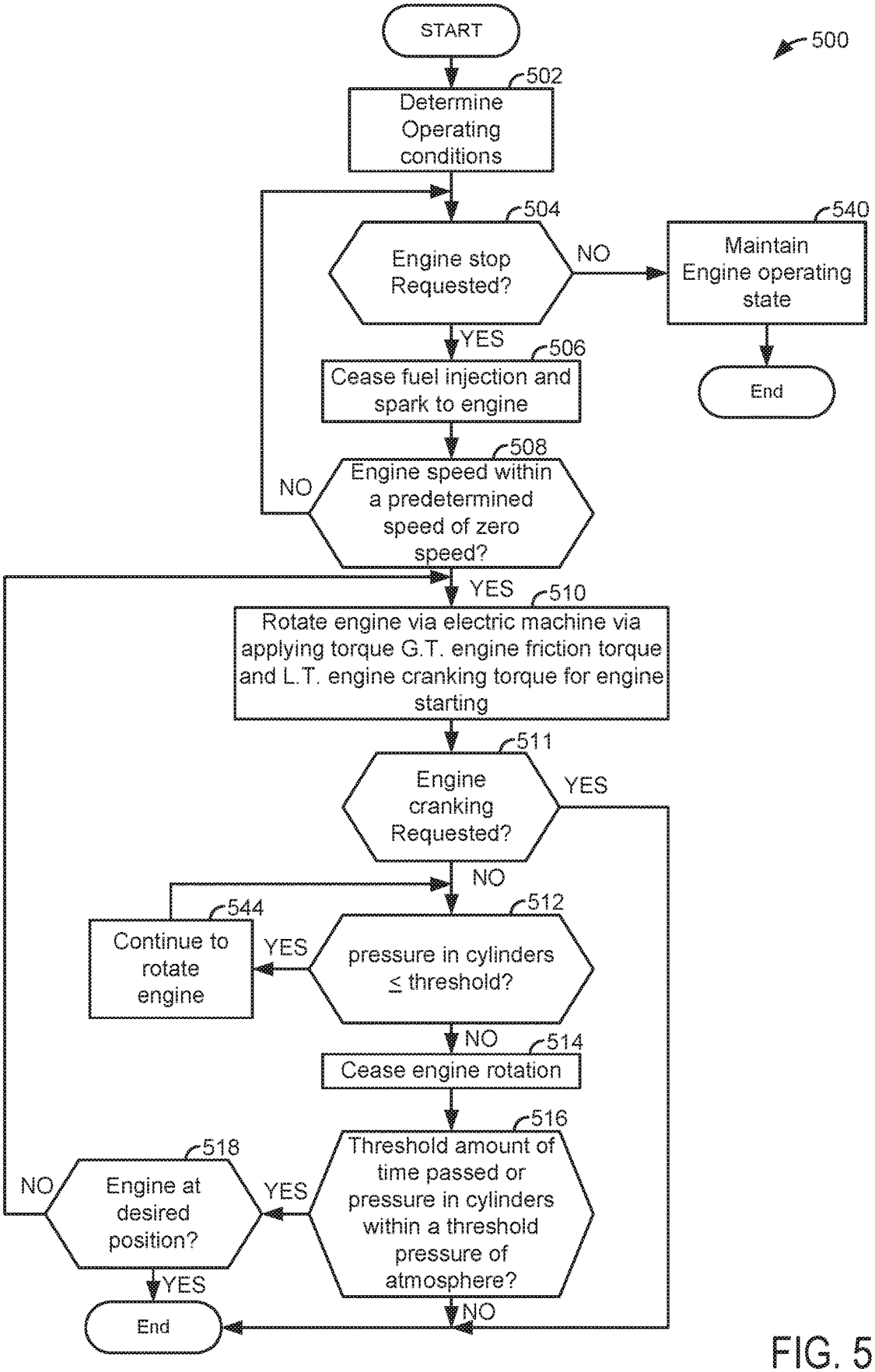
FIG. 5 shows a flow chart of an engine stop position control sequence.

Referring now to FIG. 5, a flow chart of a method for operating an engine of a vehicle driveline is shown. The method of FIG. 5 may be incorporated into and may cooperate with the system of FIGS. 1 and 2. Further, at least portions of the method of FIG. 5 may be incorporated as executable instructions stored in non-transitory memory while other portions of the method may be performed via a controller transforming operating states of devices and actuators in the physical world.

At 502, method 500 determines operation conditions. Operating conditions may include but are not limited to engine speed, engine temperature, BISG torque, ISG torque, driver demand torque, engine load, ambient temperature, ambient pressure, vehicle speed, and BISG speed. Method 500 proceeds to 504.

At 504, method 500 judges if an engine stop is requested. An engine stop (e.g., stop engine rotation) may be requested via a human driver supplying input to a human/machine interface or an automated driver. The engine may automatically be requested to stop when driver demand torque is less than a threshold torque. If method 500 judges that an engine stop is requested, the answer is yes and method 500 proceeds to 506. Otherwise, the answer is no and method 500 proceeds to 540.

At 540, method 500 maintains the present engine operating state. If the engine is on and it is combusting fuel, the engine remains on. If the engine is stopped (e.g., not rotating), the engine remains stopped. Method 500 proceeds to exit after maintaining the engine operating state.

At 506, method 500 ceases fuel injection to the engine. Method 500 also ceases spark delivery to the engine. Method 500 may also disconnect the engine from the remainder of the driveline via the driveline disconnect clutch (e.g., open the driveline disconnect clutch) so that the vehicle may continue to move without the engine having to rotate. Method 500 proceeds to 508.

At 508, method 500 judges if engine speed is within a predetermined speed of zero engine speed. If method 500 judges that engine speed is within a predetermined speed of zero rotational speed, the answer is yes and method 500 continues to 510. Otherwise, method 500 returns to 504.

At 510, method 500 rotates the engine via an electric machine. The electric machine may be a low voltage starter (e.g., 96), a BISG (e.g., 219), an ISG (e.g., 240), or other electric machine. The electric machine applies an amount of torque to the engine that is greater than (G.T.) engine friction torque, but less than (L.T.) torque applied to rotate the engine at cranking speed during engine starting. This torque allows the engine to rotate without causing a change in cylinder pressure that is significant enough to rotate the engine when the electric machine ceases to supply torque to the engine. The engine may be rotated in a forward direction (e.g., clockwise) or a reverse direction (anti-clockwise), whichever direction allows the engine to reach the desired engine stopping position sooner. Method 500 proceeds to 511.

At 511, method 500 judges whether or not engine cranking for an engine start is requested. In one example, if an engine start is requested via a human or automated driver, the answer is yes and method 500 cranks the engine and proceeds to exit. Otherwise, the answer is no and method 500 proceeds to 512.

At 512, method 500 judges if a pressure within one or more cylinders (e.g., an absolute value of a pressure), beginning from a time just before the engine began to rotate most recently, is less than a threshold pressure. In one example, the threshold pressure is a pressure is a predetermined pressure that is less than a pressure that when combined with pressures in other cylinders rotates the engine after the electric machine ceases to provide torque to the engine. For example, if the engine will continue to rotate after the electric machine ceases to supply torque to the engine when pressure in one or more cylinders is greater than 60 kilopascals (kPa), then the threshold pressure may be 55 kPa so that if the pressure in one or more cylinders exceeds 55 kPa, then the answer is no and method 500 proceeds to 514. However, if pressure in one or more cylinders is less than the 55 kPa, the answer is yes and method 500 proceeds to 544. Note that the values of 60 kPa and 55 kPa are for purposes of example only and are not intended to limit the scope of this disclosure. Further, the threshold value may be determined via rotating the engine with an electric machine and monitoring pressures in one or more cylinders relative to atmospheric pressure that causes the engine to rotate when torque from the electric machine is reduced to zero.

Alternatively, method 500 may judge if the engine has been rotated a predetermined distance from the position the engine where the engine was most recently stopped (not rotating). For example, it may be determined that for every X degrees of crankshaft rotation, pressure in a cylinder increases or decreases by a predetermined amount from atmospheric pressure. Therefore, the engine may be rotated through a crankshaft angle that is less than the predetermined distance to ensure that the engine does not rotate after the electric machine ceases to supply torque to the engine. As such, if method 500 judges that the engine has rotated through less than a threshold number of crankshaft degrees, the answer is yes and method 500 proceeds to 544. Otherwise, the answer is no and method 500 proceeds to 514.

In still another alternative, method 500 may judge if the engine has rotated for a predetermined amount of time since the engine was most recently stopped. For example, it may be determined that the engine will rotate 5 crankshaft degrees/second and that 5 degrees of crankshaft rotation increases or decreases cylinder pressure by a predetermined amount from atmospheric pressure. Therefore, the engine may be rotated for less than a predetermined amount of time to ensure that the engine does not rotate after the electric machine ceases to supply torque to the engine. As such, if method 500 judges that the engine has rotated for less than a threshold amount of time, the answer is yes and method 500 proceeds to 544. Otherwise, the answer is no and method 500 proceeds to 514.

At 544, method 500 continues to rotate the engine via the electric machine by applying the same torque as applied at step 510. Method 500 returns to 512.

At 514, method 500 ceases to supply torque to the engine via the electric machine, thereby ceasing engine rotation. Method 500 proceeds to 516.

At 516, method 500 judges if pressure (e.g., an absolute value of pressure) within the cylinder is within a threshold pressure of atmospheric pressure. In other words, method 500 judges if pressure in the cylinder has increased or decreased such that pressure in the cylinder is within a threshold pressure of atmospheric pressure (e.g., within 15 kPa of atmospheric pressure). Pressure within the cylinder may move toward atmospheric pressure whether pressure in the cylinder is greater than or less than atmospheric pressure. In particular, air may flow into or out of a cylinder and pass piston rings when the engine is not rotating. Consequently, pressure in an engine cylinder may be limited so that the engine does not rotate when the electric machine ceases to supply torque to the engine. If method 500 judges that the pressure in the engine cylinder is within a threshold pressure of atmospheric pressure, the answer is yes and method 500 proceeds to 518. Otherwise, the answer is no and method 500 proceeds to exit.

Alternatively, method 500 may judge if the engine has stopped rotating for a predetermined amount of time since the engine was most recently rotating. For example, it may be determined that pressure in an engine cylinder may drop at a rate that is a function of time. Therefore, it may be estimated that pressure in the engine cylinder will be less than a threshold pressure after the engine ceases rotating for a predetermined amount of time. As such, if method 500 judges that the engine has been stopped for a threshold amount of time, the answer is yes and method 500 proceeds to 518. Otherwise, the answer is no and method 500 proceeds to exit.

At 518, method 500 judges if the engine is stopped at a desired stopping position (e.g., a predetermined number of crankshaft degrees before intake valve closing of a particular engine cylinder). If method 500 judges that the engine is at a desired engine stopping position, the answer is yes and method 500 proceeds to exit. Otherwise, the answer is no and method 500 returns to 510. The engine is started from the desired engine stop position via an electric machine in response to an engine start request after method 500 exits. Alternatively, the engine may be started at 518 when an engine start is requested.

In this way, the engine may be rotated, stopped, rotated, and stopped as shown in FIG. 4 to move the engine's stopping position and prepare the engine for a subsequent engine restart. By limiting engine rotation and torque to rotate the engine, it may be possible to limit pressure in engine cylinders so that the engine does not rotate when an electric machine ceases supplying torque to the engine. As such, the engine may stay in its desired stopping position in preparation for an engine restart.

The method of FIG. 5 provides for an engine operating method, comprising: a plurality of times, rotating and stopping rotation of an engine after an engine stop request and before an engine start request via a controller. The method includes where the engine is rotated via an electric machine. The method includes where the electric machine is a starter motor. The method includes where the electric machine is a belt integrated starter/generator. The method includes where the electric machine is a driveline integrated/starter generator. The method includes where stopping rotation of the engine includes stopping the engine for a predetermined amount of time. The method includes where stopping rotation of the engine includes stopping the engine while an absolute value of a pressure in an engine cylinder is a threshold pressure greater than atmospheric pressure.

The method of FIG. 5 also provides for an engine operating method, comprising: a plurality of times, rotating and stopping rotation of an engine after an engine stop request and before an engine start request via a controller, where rotating the engine includes applying an average torque to the engine while the engine is rotating that is less than an average engine cranking torque while the engine is rotating during engine starting and that is greater than an engine friction torque. The method further comprises rotating the engine a predetermined crankshaft angle each of the plurality of times the engine is rotated. The method further comprises rotating the engine while an absolute value of a pressure in an engine cylinder is less than a threshold pressure each of the plurality of times the engine is rotated. The method further comprises stopping the engine at a predetermined position after rotating the engine the plurality of times. The method includes where the predetermined position is within a threshold actual total number of crankshaft degrees of intake valve closing time of a cylinder. The method includes where the engine is rotated the plurality of times without supplying fuel to the engine. The method further comprises stopping rotation of the engine for a predetermined amount of time each of the plurality of times the engine is stopped.

Note that the example control and estimation routines included herein can be used with various engine and/or vehicle system configurations. The control methods and routines disclosed herein may be stored as executable instructions in non-transitory memory and may be carried out by the control system including the controller in combination with the various sensors, actuators, and other engine hardware. The specific routines described herein may represent one or more of any number of processing strategies such as event-driven, interrupt-driven, multi-tasking, multi-threading, and the like. As such, various actions, operations, and/or functions illustrated may be performed in the sequence illustrated, in parallel, or in some cases omitted. Likewise, the order of processing is not necessarily required to achieve the features and advantages of the example embodiments described herein, but is provided for ease of illustration and description. One or more of the illustrated actions, operations and/or functions may be repeatedly performed depending on the particular strategy being used. Further, at least a portion of the described actions, operations and/or functions may graphically represent code to be programmed into non-transitory memory of the computer readable storage medium in the control system. The control actions may also transform the operating state of one or more sensors or actuators in the physical world when the described actions are carried out by executing the instructions in a system including the various engine hardware components in combination with one or more controllers.

This concludes the description. The reading of it by those skilled in the art would bring to mind many alterations and modifications without departing from the spirit and the scope of the description. For example, single cylinder, I3, I4, I5, V6, V8, V10, and V12 engines operating in natural gas, gasoline, diesel, or alternative fuel configurations could use the present description to advantage.

The invention claimed is:

1. An engine operating method, comprising:

a plurality of times, rotating and stopping rotation of an engine after an engine stop request and before an engine start request via a controller, where the rotating the engine follows stopping rotation of the engine each of the plurality of times, and where the engine is stopped each of the plurality of times for a time that is based on a pressure in a cylinder of the engine.

2. The method of claim 1, where the engine is rotated via an electric machine in only one direction.

3. The method of claim 2, where the electric machine is a starter motor.

4. The method of claim 2, where the electric machine is a belt integrated starter/generator.

5. The method of claim 2, where the electric machine is a driveline integrated/starter generator.

6. The method of claim 1, where the time is a predetermined amount of time.

7. The method of claim 1, where stopping rotation of the engine includes stopping the engine while an absolute value of the pressure in the engine cylinder is a threshold pressure greater than atmospheric pressure.

8. An engine operating method, comprising:

a plurality of times, rotating and stopping rotation of an engine after an engine stop request and before an engine start request via a controller, where rotating the engine includes applying an average torque to the engine while the engine is rotating that is less than an average engine cranking torque while the engine is rotating during engine starting and that is greater than an engine friction torque, where rotating the engine follows stopping rotation of the engine each of the plurality of times for a time that is based on a pressure in a cylinder of the engine.

9. The method of claim 8, further comprising rotating the engine a predetermined crankshaft angle each of the plurality of times the engine is rotated.

10. The method of claim 8, further comprising rotating the engine while an absolute value of the pressure in the engine cylinder is less than a threshold pressure each of the plurality of times the engine is rotated.

11. The method of claim 8, further comprising stopping the engine at a predetermined position after rotating the engine the plurality of times.

12. The method of claim 11, where the predetermined position is within a threshold actual total number of crankshaft degrees of intake valve closing time of the cylinder.

13. The method of claim 8, where the engine is rotated the plurality of times without supplying fuel to the engine.

14. The method of claim 8, further comprising stopping rotation of the engine for a predetermined amount of time each of the plurality of times the engine is stopped.

15. A system, comprising:

an engine;

an electric machine; and a controller including executable instructions stored in non-transitory memory to rotate the engine and cease engine rotation a plurality of times after an engine stop request and before an engine start request via the electric machine, where the rotating the engine follows stopping rotation of the engine each of the plurality of times for a time that is based on a pressure in a cylinder of the engine.

16. The system of claim 15, further comprising additional instructions to stop the engine at a predetermined position after rotating the engine the plurality of times.

17. The system of claim 15, where ceasing engine rotation includes stopping the engine when an absolute value of a pressure in an engine cylinder is a threshold pressure greater than atmospheric pressure.

18. The system of claim 15, where the electric machine is a belt integrated starter/generator.

19. The system of claim 15, further comprising additional instructions to stop the engine for a predetermined amount of time each of the plurality of times the engine ceases rotating.

20. The system of claim 15, where the electric machine is a starter motor.

* * * * *